US012578165B1

(12) United States Patent
Gomez et al.

(10) Patent No.: US 12,578,165 B1
(45) Date of Patent: Mar. 17, 2026

(54) HANDGUARD MOUNTING SYSTEM

(71) Applicant: Aero Precision, LLC, Tacoma, WA (US)

(72) Inventors: Jesus Gomez, Madison, AL (US); Dustin Yearicks, Seatac, WA (US); Jason Miller, New Market, AL (US)

(73) Assignee: Aero Precision, LLC, Tacoma, WA (US)

( * ) Notice: Subject to any disclaimer, the term of this patent is extended or adjusted under 35 U.S.C. 154(b) by 0 days.

(21) Appl. No.: 18/670,535

(22) Filed: May 21, 2024

Related U.S. Application Data

(60) Provisional application No. 63/467,994, filed on May 21, 2023.

(51) Int. Cl.
*F41C 23/16* (2006.01)
*F41A 21/48* (2006.01)

(52) U.S. Cl.
CPC ..... *F41C 23/16* (2013.01); *F41A 21/48* (2013.01)

(58) Field of Classification Search
CPC .. F41A 21/48; F41A 11/00; F41A 3/66; F41C 23/16
See application file for complete search history.

(56) References Cited

U.S. PATENT DOCUMENTS 8,904,691 B1 * 12/2014 Kincel ..... F41C 23/16 42/71.01
10,145,648 B1 * 12/2018 Holder ..... F41C 23/16
D844,094 S * 3/2019 Geissele ..... D22/108
10,352,650 B2 * 7/2019 Hiler, Jr. ..... F41A 21/482
10,401,122 B2 * 9/2019 Williams ..... F41G 11/003
10,775,129 B1 * 9/2020 Kincel ..... F41C 23/16
12,203,725 B2 * 1/2025 Boomgaarden ..... F41C 23/16
2011/0192066 A1 * 8/2011 Kimmel ..... F41C 23/16 42/71.01
2011/0247254 A1 * 10/2011 Barnes ..... F41A 21/48 42/75.01
2012/0124880 A1 * 5/2012 Leclair ..... F41C 23/16 42/71.01
2014/0130390 A1 * 5/2014 Geissele ..... F41C 23/16 42/71.01
2014/0373419 A1 * 12/2014 Leclair ..... F41C 23/16 42/71.01
2015/0369555 A1 * 12/2015 Daniel ..... F41A 21/487 42/75.02
2017/0059273 A1 * 3/2017 Geissele ..... F41C 23/16
2019/0170476 A1 * 6/2019 Hiler, Jr. ..... F41A 21/482
2020/0232732 A1 * 7/2020 Noonan ..... F41A 3/66
2022/0018629 A1 * 1/2022 Senff ..... F41C 23/18
(Continued)

*Primary Examiner* — Joshua E Freeman
(74) *Attorney, Agent, or Firm* — Bamert Regan PLLC

(57) ABSTRACT

Embodiments are directed toward a handguard system for a rifle. In some embodiments, the system includes a handguard and a fastener. The upper portion of the handguard defines fastener apertures in opposite sides of the handguard. The fastener is configured to extend through the fastener apertures and to clamp the handguard to a barrel nut. In some embodiments, the system is devoid of separable components disposed between at least one end portion of the first fastener and an exterior surface of the handguard when the handguard is fully installed on the rifle. Accordingly, the system increases the ease of installing and servicing the handguard on the rifle.

20 Claims, 12 Drawing Sheets

(56) References Cited

U.S. PATENT DOCUMENTS

| | | | | |
|---|---|---|---|---|
| 2022/0228838 | A1* | 7/2022 | Wiggins | F41C 23/16 |
| 2023/0129047 | A1* | 4/2023 | Miller | F41C 23/16<br>42/75.01 |
| 2023/0324140 | A1* | 10/2023 | Olsen | F41A 3/66<br>42/72 |
| 2024/0151493 | A1* | 5/2024 | DiChario | F41C 23/16 |

* cited by examiner

HANDGUARD MOUNTING SYSTEM

CROSS-REFERENCE TO RELATED APPLICATION

The present application claims the benefit of the filing date of provisional patent application Ser. No. 63/467,994, filed on May 21, 2023, titled HANDGUARD MOUNTING SYSTEM under 35 U.S.C. § 119, the entirety of which is hereby incorporated herein by reference.

FIELD OF THE INVENTION

The invention relates generally to firearm handguards and, more particularly, to handguard mounting systems for AR-15 firearms and similarly patterned firearms such as the AR-10.

BACKGROUND OF THE INVENTION

The M16 is a lightweight, 5.56 mm, air-cooled, gas-operated, magazine-fed rifle with a rotating bolt, actuated by direct impingement gas operation. The rifle is made from steel, aluminum, and composite plastic and polymer materials and is the primary service rifle for the United States military. The M16 entered U.S. Army service as the M16 A1 in South Vietnam in 1963, replacing the M14 rifle. A civilian semi-automatic version of the M16 is designated as AR-15. The AR-15 semi-automatic rifle has become very popular with hobbyists and gun collectors in the United States. The rifle serves various purposes from target shooting to hunting to varmint control. In that regard it has become very popular to modify the AR-15 with a variety of accessories such as hunting rifle telescopic sights, bipods, infrared illuminators, and night vision telescopic sights. To accommodate such accessories, a handguard having accessory rails for mounting such accessories can be installed on the firearm instead of the standard-issue, thermal-set plastic handguard on the AR-15.

Historically, handguards having rails have been multi-segmental and thus difficult to machine to sufficiently high standards and tolerances such that unsightly gaps do not develop between mating surfaces while the handguards go through dramatic thermocycling during operation of the rifle. Moreover, separate clamp mechanisms are typically used to hold handguards on the firearm, and such clamps have significant surface area thermally coupled to the barrel nut, which experiences extreme thermocycles. Accordingly, typical clamps place highly variable stress on the handguard during the thermocycle and thus negatively impacted the stability and precision of the mounted accessories.

Attempts have been made to address the shortcomings of traditional handguards and their mounting systems, such as the mounting system taught in U.S. Pat. No. 8,904,691, titled FIREARM HANDGUARD ASSEMBLY. Such mounting systems, however, are cumbersome to use because they have many pieces that must simultaneously be held in place by the user until the user interlocks two bolts with each other after insertion through opposite sides of the other mounting components and the handguard, all while holding a separate indexing plate between the handguard and the upper receiver to prevent rotation of the handguard relative to the upper receiver. Accordingly, such mounting systems make field service and installation of the handguard difficult.

Other attempts, such as the mounting system taught in U.S. Pat. No. 9,599,430, titled FIREARM HANDGUARD, increase the risk of distortion to the contour of the handguard, which reduces the strength of the coupling of the handguard to the upper receiver and degrades performance of the mounted accessories.

For these reasons, there is a need for a durable, reliable handguard and mounting system that are suitable for hard use, such as military or police operations, while maintaining stability and accurate performance of mounted accessories. There is also a need for a handguard and mounting system that facilitate easy installation and field servicing.

SUMMARY OF THE INVENTION

It is therefore an object of the present invention to provide a handguard and mounting system that provide consistent clamping force throughout the handguard surface that interfaces with the barrel nut.

It is also an object of the present invention to provide a handguard and mounting system that achieve the above object and that also have a durable, reliable connection to the firearm for hard use, such as military or police operations.

It is another object of the present invention to provide a handguard and mounting system that achieve the above objects and that also maintain stability and accurate performance of accessories mounted to the handguard.

It is a further object of the present invention to provide a handguard and mounting system that achieve the above objects and that also facilitate easy installation and field servicing.

The invention achieves the above objects, as well as other objects and advantages that will become apparent from the description that follows, by providing a handguard system for a rifle. The system has a handguard and a fastener. The upper portion of the handguard defines fastener apertures in opposite sides of the handguard. The fastener is configured to extend through the apertures and to clamp the handguard to a barrel nut. In some embodiments, the system is devoid of separable components disposed between at least one end portion of the first fastener and an exterior surface of the handguard when the handguard is fully installed on the rifle. Accordingly, the system increases the ease of installing and servicing the handguard on the rifle.

In some embodiments, the handguard defines at least one recess in the rear end portion of the handguard to receive at least one portion of an upper receiver of the rifle. Accordingly, the at least one recess prevents the handguard from rotating relative to the upper receiver.

In some embodiments, the upper portion of the handguard defines another pair of apertures in the opposite sides of the handguard. In some embodiments, a second fastener is configured to extend through the second pair of fastener apertures and to clamp the handguard to the barrel nut. In some embodiments, the second pair of apertures are configured to prevent the fasteners from contacting each other.

In some embodiments, the handguard defines a brace on one side of the upper portion of the handguard. In some embodiments, the first brace defines one of the fastener apertures and provides an exterior surface that is approximately perpendicular to a longitudinal axis of the first fastener. Accordingly, the brace facilitates increasing the clamping force applied to the handguard without additional components being handled during installation of the handguard on the rifle.

In some embodiments, the handguard defines another brace on the opposite side of the upper portion of the handguard from the first brace. In some embodiments, the second brace defines another of the apertures and provides another exterior surface that is approximately perpendicular to the longitudinal axis of the first fastener. Accordingly, the second brace facilitates increasing the clamping force applied to the handguard without additional components being handled during installation of the handguard on the rifle. In some embodiments, each of the braces defines two of the apertures.

In some embodiments, the system includes a threaded plate or nut plate that is configured to threadably receive at least one of the fasteners while the plate is disposed on the exterior surface of one of the braces.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

A handguard and a handguard mounting system in accordance with the principles of the present disclosure are generally respectively indicated at reference numbers 8 and 10 in the Figures of the attached drawings, wherein numbered elements in the Figures correspond to like numbered elements herein.

Figure 1:
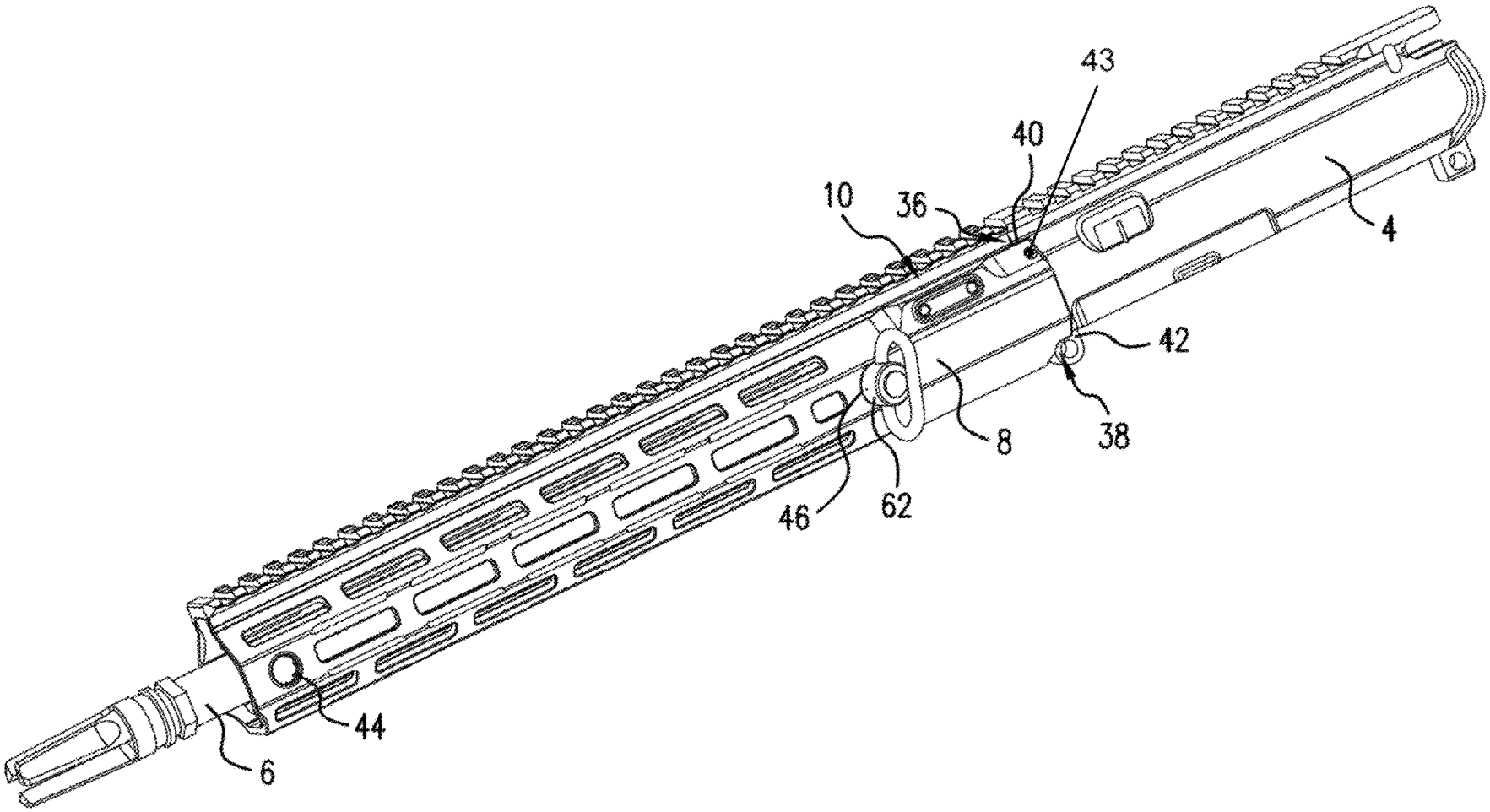
FIG. 1 is an isometric perspective view of a handguard and mounting system.
Figure 2:
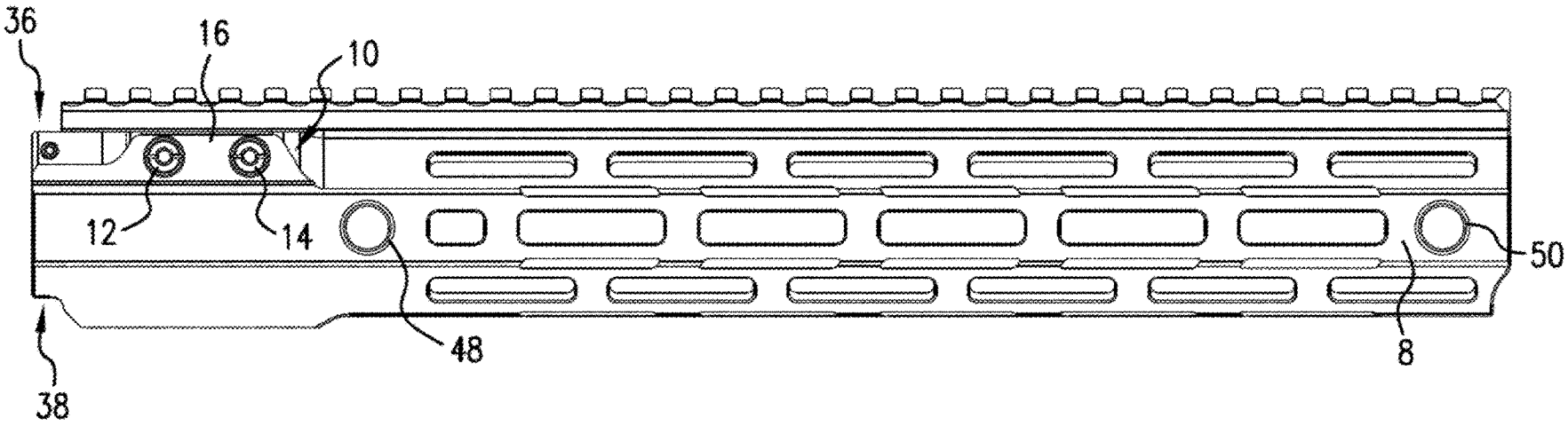
FIG. 2 is an isometric right-side elevational view of the handguard and mounting system of FIG. 1.
Figure 3:
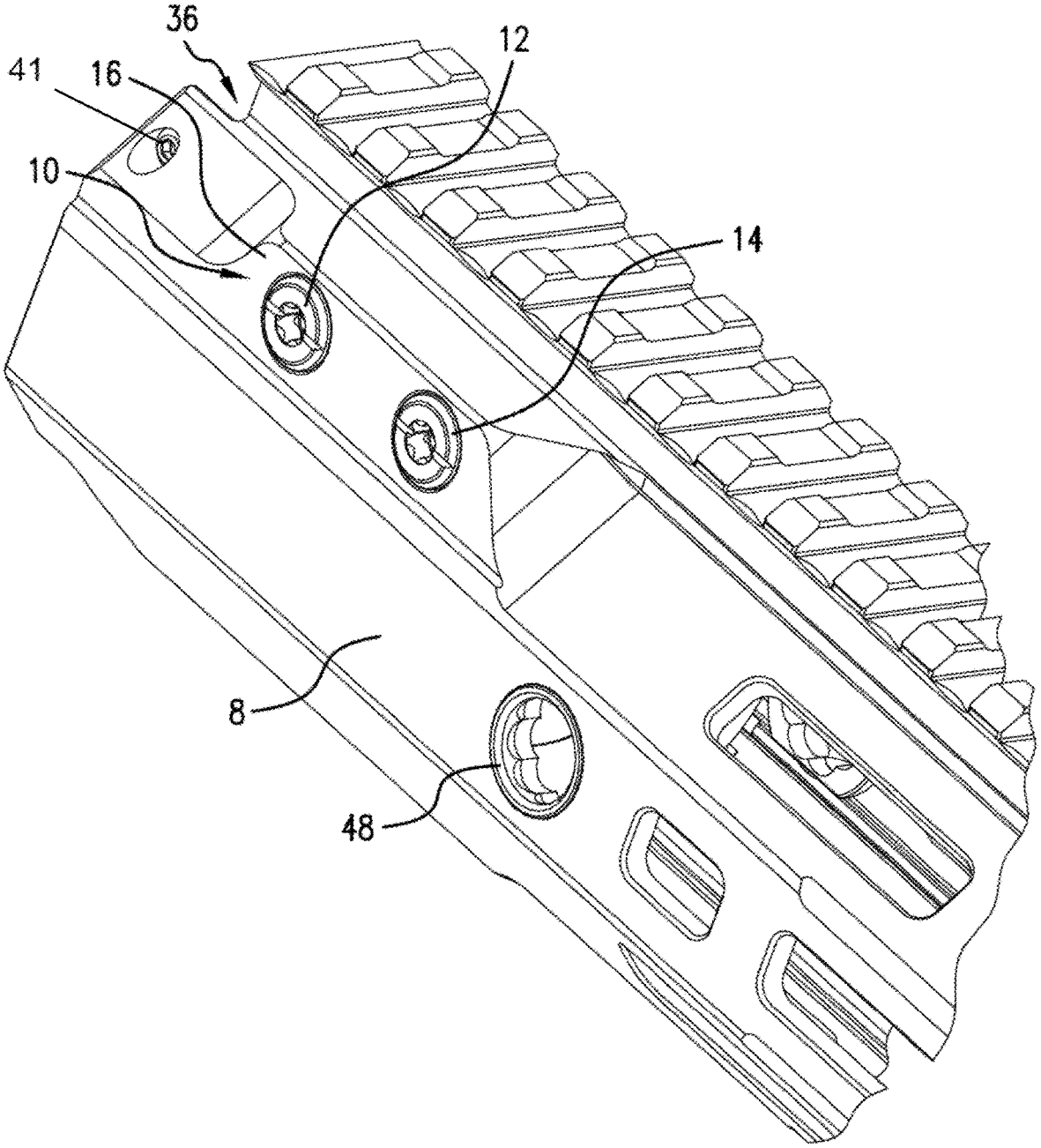
FIG. 3 is an isometric close-up perspective view of the handguard and mounting system of FIG. 1.
Figure 4:
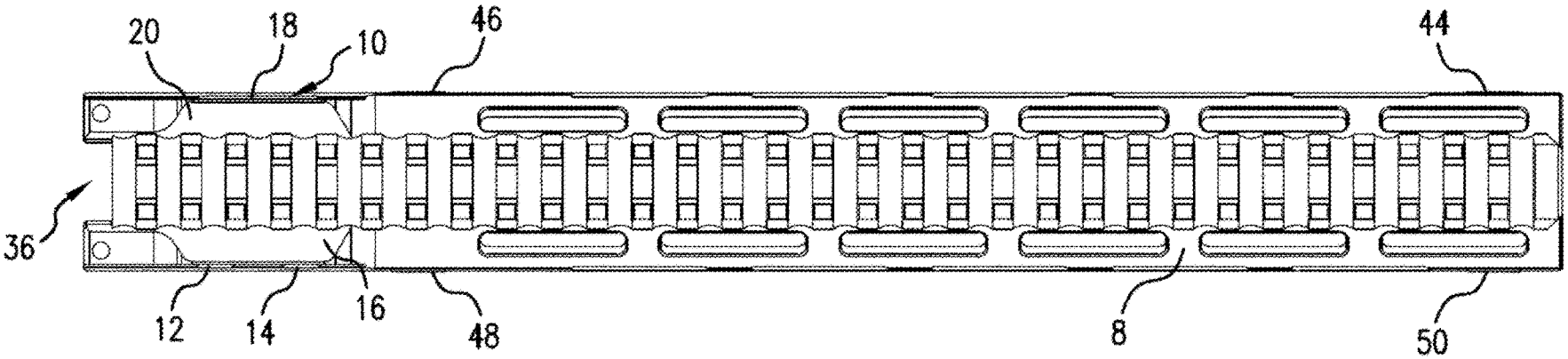
FIG. 4 is an isometric top plan view of the handguard and mounting system of FIG. 1.
Figure 5:
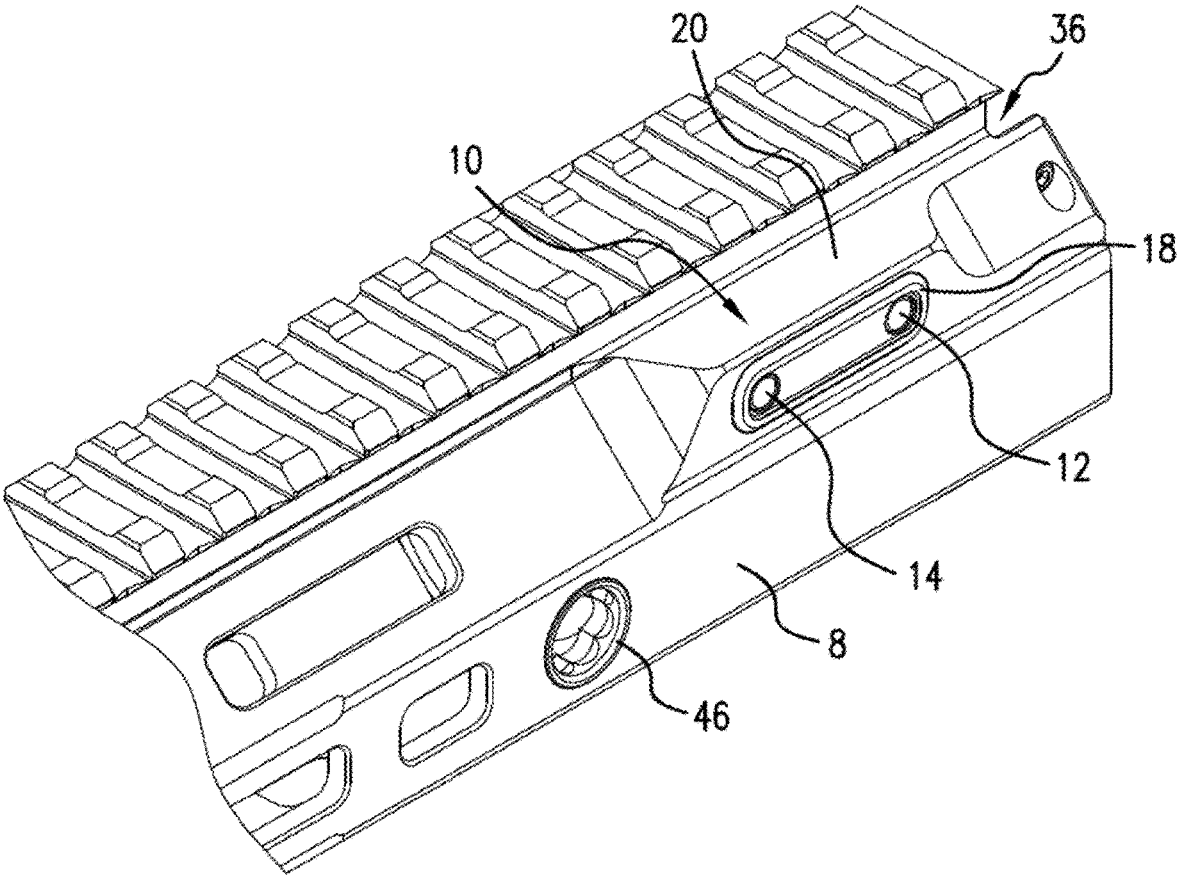
FIG. 5 is an isometric close-up perspective view of the handguard and mounting system of FIG. 1.

As shown in FIG. 1, a firearm is depicted having an upper receiver 4 to which a barrel 6 is coupled. The firearm may be an AR-15 firearm or similarly patterned firearm such as an AR-10, or others. In some embodiments, the handguard 8 is a unitary structure that covers at least a portion of the barrel 6 and is coupled to the upper receiver by the mounting system 10. As shown in FIGS. 2 and 3, the mounting system 10 includes at least one pin or fasteners, such as threaded bolts 12, 14, and in some embodiments includes a brace 16 that is integral to the handguard 8. However, in some embodiments, the brace 16 is formed separately and coupled to the handguard 8. As shown in FIGS. 4 and 5, the mounting system 10 in some embodiments also includes a threaded plate or nut plate 18 that acts as a nut for each of the at least one bolt. In some embodiments, the mounting system 10 further includes a brace 20 that is integral to the handguard 8. However, in some embodiments, the brace 20 may be formed separately and coupled to the handguard 8.

Figure 7:
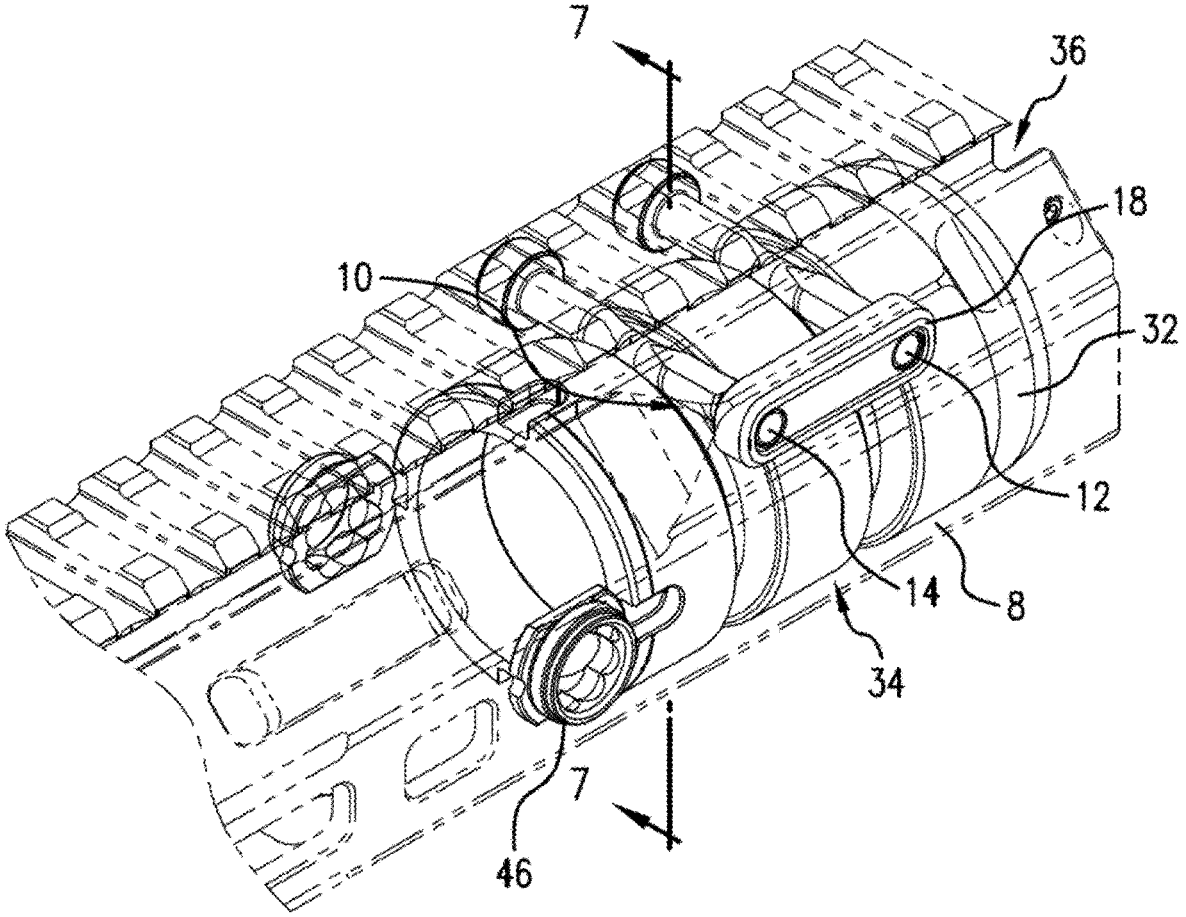
FIG. 7 is an isometric close-up perspective view of the handguard and mounting system of FIG. 1 with the handguard being transparent for visualization purposes.
Figure 8:
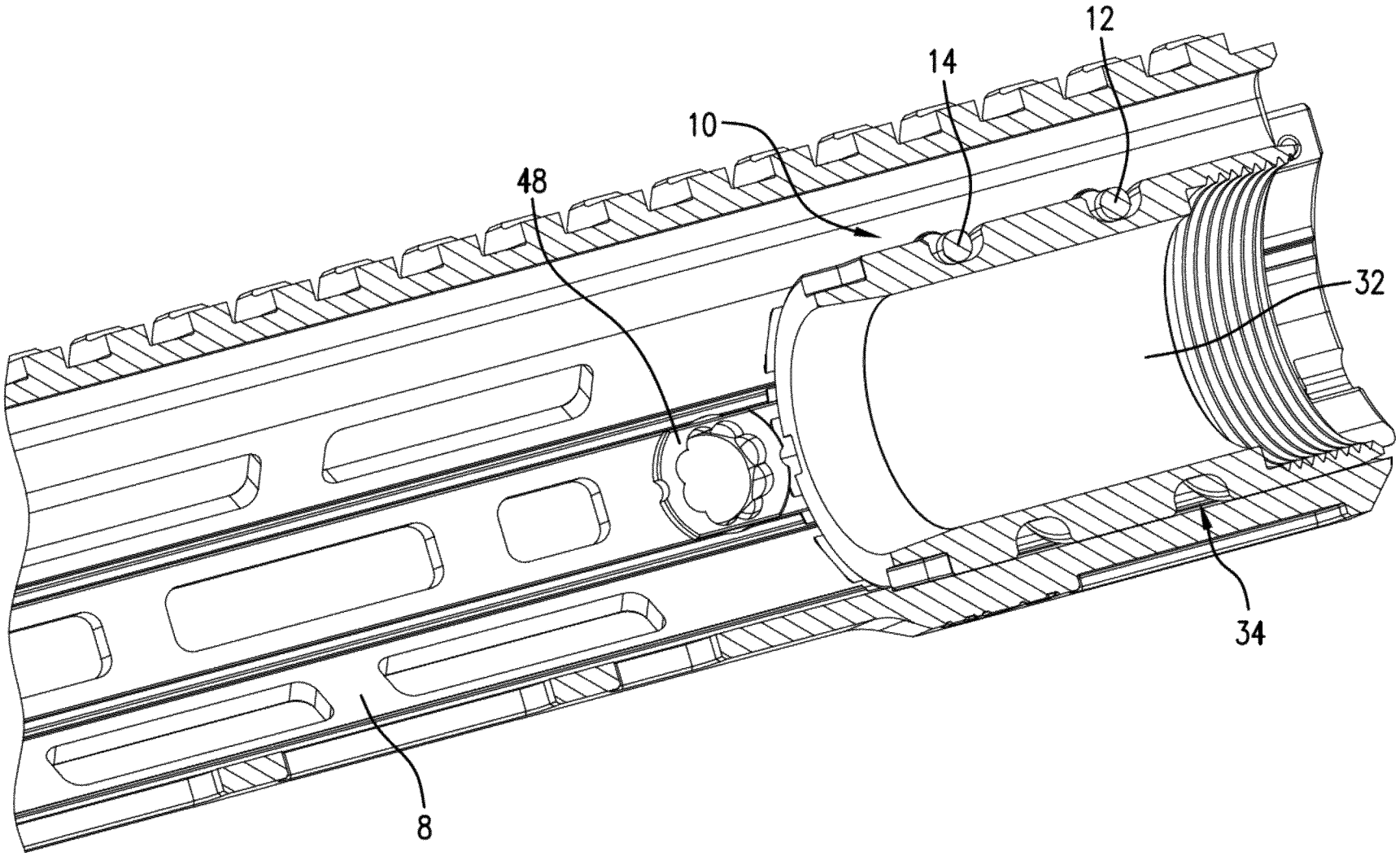
FIG. 8 is an isometric cross-sectional view of the handguard and mounting system of FIG. 1 taken along the line 7-7 in FIG. 7.
Figure 9:
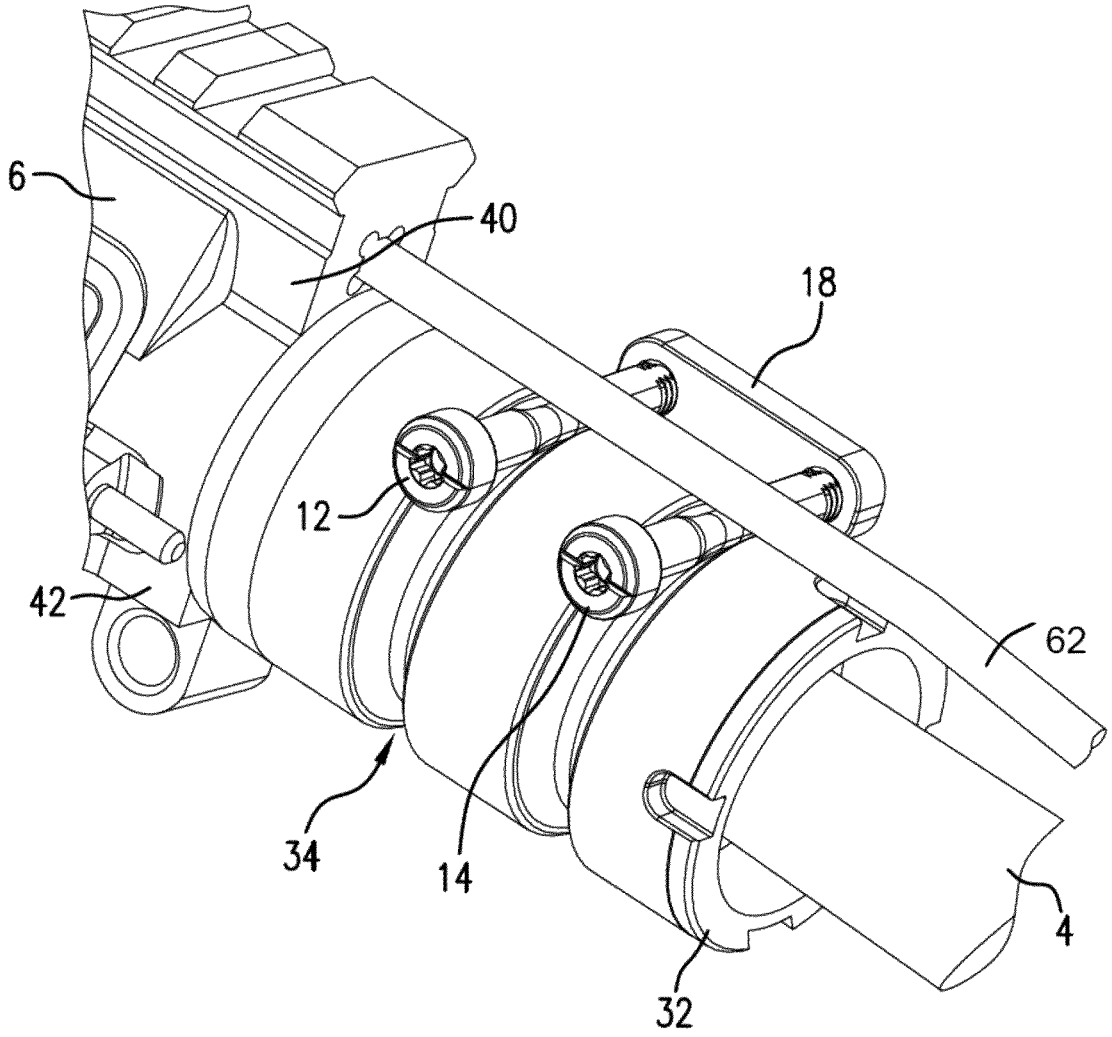
FIG. 9 is an isometric close-up perspective view of a portion of the mounting system of FIG. 1.

As shown in FIGS. 7-9, the mounting system 10 clamps the handguard 8 to the barrel nut 32, which is coupled to the upper receiver 4. The bolts 12, 14 extend through fastener apertures defined by the braces 16, 20, where the fastener apertures are disposed on opposing sides of the handguard 8 and aligned such that an axis of each fastener extends through fastener apertures on the opposing sides. In such configuration, the handguard 8 may define first and third fastener apertures formed in the brace 16, and second and fourth fastener apertures formed in the brace 20, where the first and second fastener apertures are aligned along an axis of the fastener 12, and the third and fourth fastener apertures are aligned along an axis of the fastener 14. The fasteners 12, 14 are received in a notch 34 defined by the barrel nut 32 and thus prevent longitudinal displacement of the handguard 8. Accordingly, the mounting system 10 provides a highly durable and reliable coupling of the handguard 8 to the upper receiver 4 while being easy to install and service. The barrel nut 32 may have a generally cylindrical shape, where the notch 34 is a reduced-radial section along a length of the barrel nut 32. The notch 34 may have a profile with ends along the length of the barrel nut 32 such that, when the fasteners 12, 14 and the barrel nut 32 are installed or positioned in the handguard 8, the fasteners 12, 14 contact ends of the notch 34 to prevent longitudinal movement of the handguard 8 relative to the barrel nut 32. When positioned in the fastener apertures, the fasteners 12, 14 are positioned between the barrel nut 32 and the accessory rail in a height direction that is perpendicular to the longitudinal direction and lateral direction.

As shown in FIGS. 7 and 9, the fasteners 12, 14 are typically installed after placing the handguard 8 over the already-installed gas impingement system, including the block (not shown) and the tube 62. However, there exists a small amount of space between the outer surface of the notch to portions of the nut 32 and the tube 62. For this reason, the bolts used in systems such as disclosed in U.S. Pat. No. 8,904,691 have small diameters. The drawback of such approach is that the bolts are subject to damage upon application of large torque forces.

Figure 11:
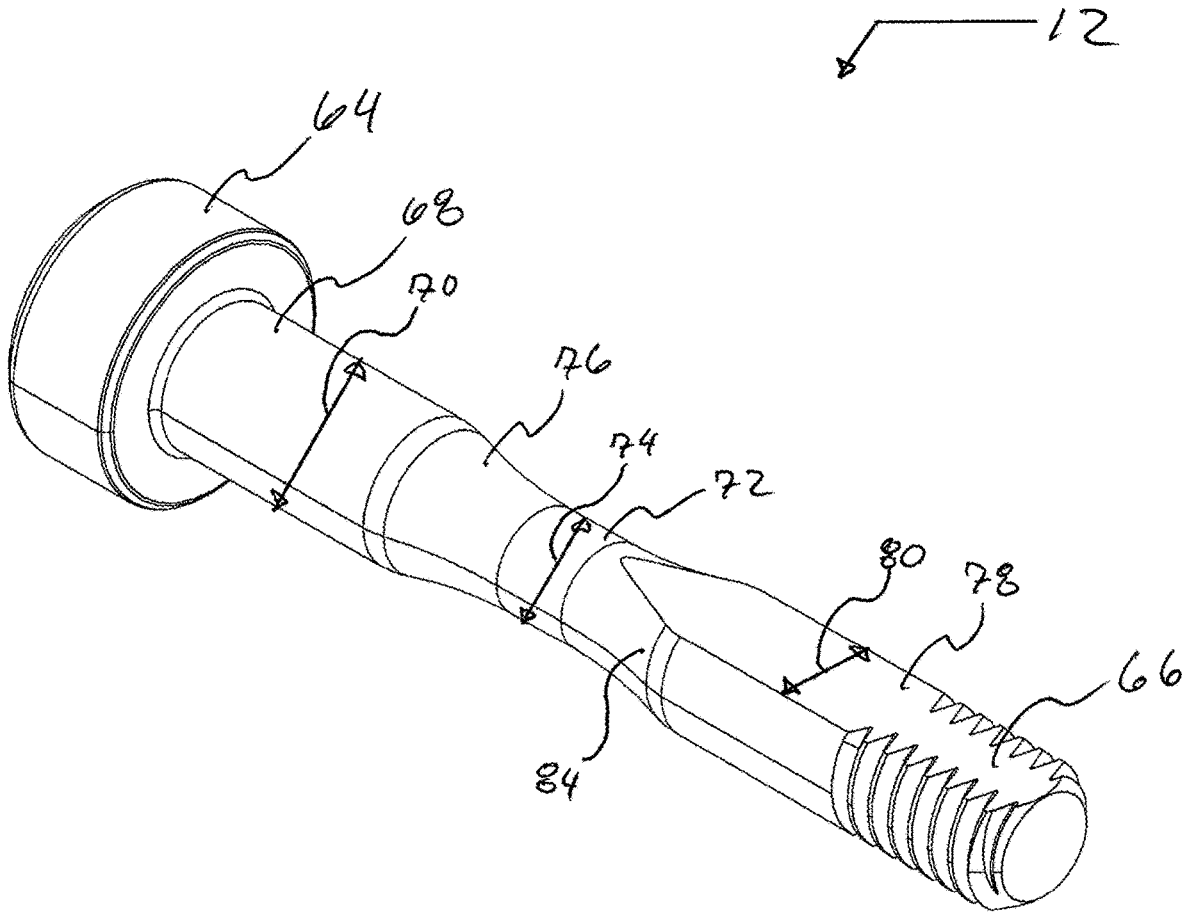
FIG. 11 is an isometric perspective view of a fastener of the handguard of FIG. 1.
Figure 12:
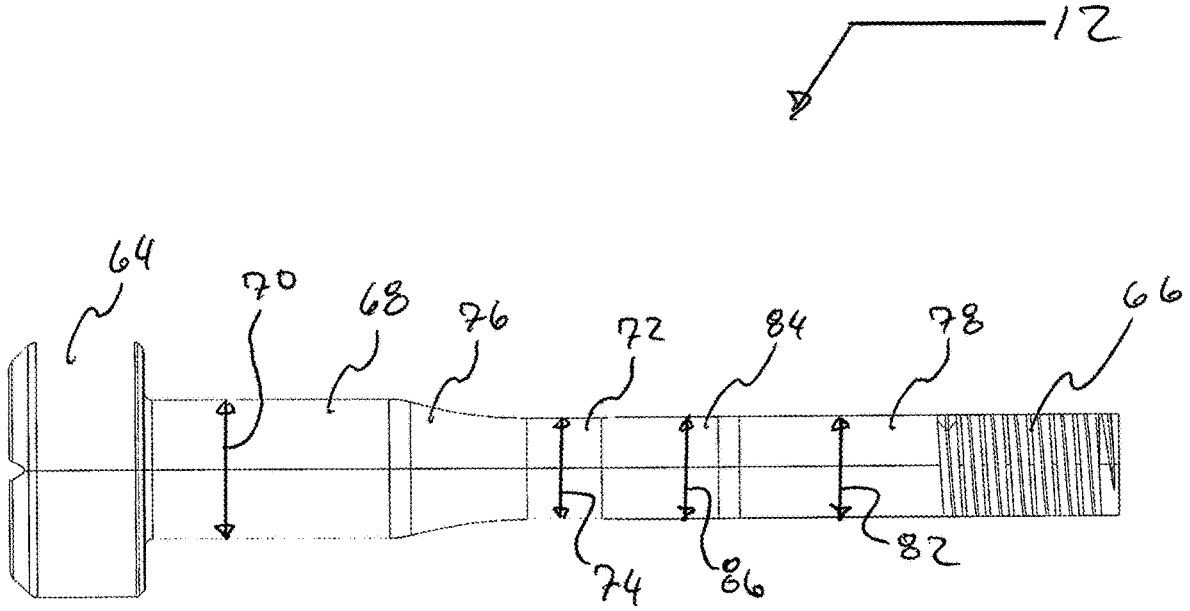
FIG. 12 is an isometric front elevational view of the fastener of FIG. 11.

In contrast, as shown in FIGS. 11 and 12, the fasteners 12, 14 are configured to fit through such small space while providing sufficient strength to prevent damage or failure when subjected to large torque forces. FIGS. 11 and 12 show the fastener 12, but the fastener 14 is arranged in the same manner. The fastener 12 has a proximal end portion that defines a head 64 and the distal end portion that defines a threaded region 66. The shaft of the fastener 12 extends from the head 64 with a large region 68 having a large diameter 70 that exceeds the distance between the notched surface of the nut 32 and the tube 62. The shaft has multiple diameters. The shaft has a tube region 72 having a diameter 74 that is at least as small as such distance. In some embodiments, the shaft has a tapered region 76 that tapers or waists down from the diameter 70 of the large region 68 to the diameter 74 of the tube region 72. Accordingly, after the fastener 12 is inserted between the nut 32 and the tube 62, the diameter 74 of the tube region 72 permits the fastener 12 to rotate without interference from the tube 62.

As shown in FIG. 11, the shaft of the fastener 12 has a widened region 78. The widened region 78 and the threaded region 66 are preferably both the slabbed, as shown in FIGS.

11 and 12. In at least one dimension, a wide diameter 80 of the widened region 78 is preferably greater than the distance between the notched surface of the nut 32 and the tube 62, as shown in FIG. 11, and also is preferably approximately the same size as the large diameter 70. In at least one other dimension, a short diameter 82 of the widened region 78 is preferably at least as small as such distance, as shown in FIG. 12. Accordingly, the fastener 12 is configured to be slid between the notched surface of the nut 32 and the tube 62 while the short diameter 82 extends along such distance. The wide diameter 80 and in the large diameter 70, however, increase the ability of the fastener 12 to withstand large torque forces applied thereto. In some embodiments, the shaft has a another tapered region 84 that, in at least one dimension, has a diameter 86 that approximately matches the diameters 74, 82 as shown in FIG. 12, but the tapered region 84 preferably has a diameter in at least one other dimension that increases from the diameter 74 to the diameter 80 as shown in FIG. 11. The threaded region 66 preferably has the same dimensions as the widened region 78, except with modifications to define the threads, as shown in FIG. 11.

Figure 6:
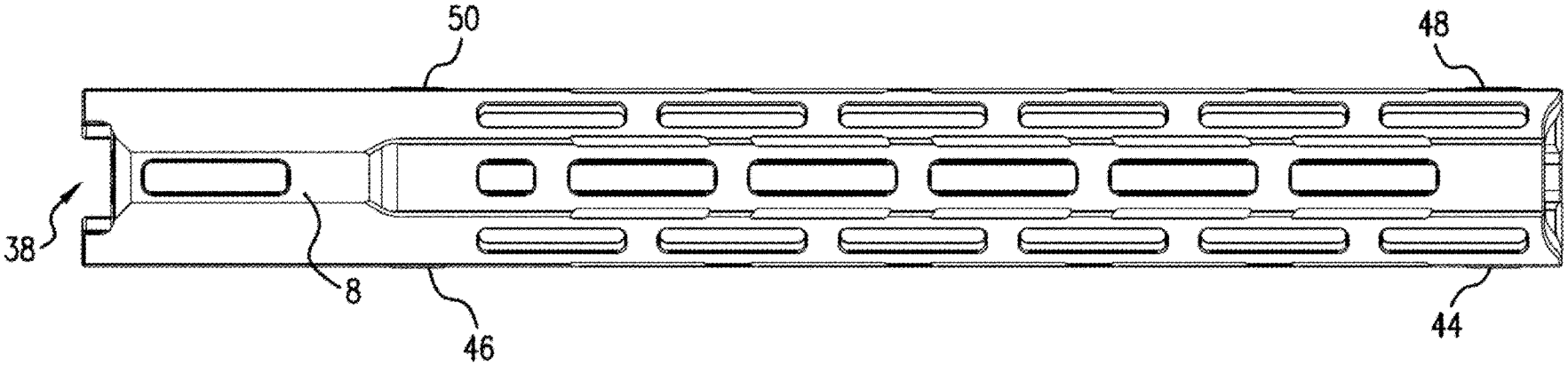
FIG. 6 is an isometric bottom plan view of the handguard of FIG. 1.

Moreover, in some embodiments, as shown in FIGS. 1, 4, and 6, the handguard 8 defines an upper recess 36 and a lower recess 38 that are configured to receive portions of the upper receiver 4, such as the upper extension 40 that supports the picatinny rail of the upper receiver 4 or the lower extension 42 that supports the downward protrusion that defines the aperture configured to receive the pivot pin that secures the upper receiver 4 to the lower receiver (not shown). Accordingly, the recesses 36, 38 are configured to prevent rotation of the handguard 8 relative to the upper receiver 4. Different receivers, however, have different dimensions, whether based on different manufacturers having different tolerances or dimensions or instead based on manufacturing variances such as the tolerances required for forging. The setscrews 41, 43 (see FIGS. 1 and 3) therefore, in some embodiments, facilitate compensating for the differences in receiver dimensions while providing a secure fit and preventing rotation of the handguard 8 relative to the upper receiver 4.

Figure 10:
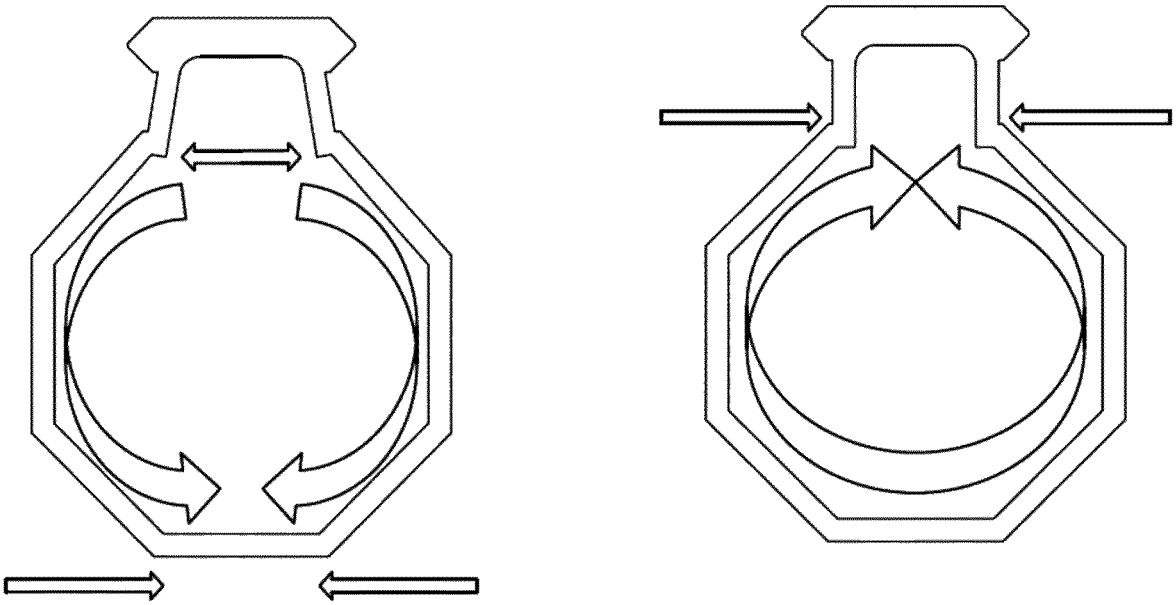
FIG. 10 is a schematic representation of a bottom clamping handguard on the left and a top clamping handguard on the right with superimposed arrows representative of force on the handguard.

As shown at left in FIG. 10, when the mounting mechanism for a handguard clamps the bottom portion of the handguard to the barrel nut, the upper portion of the handguard is forced to separate, thereby providing lesser clamping force throughout the upper portion and distorting the contour of the handguard, which reduces its interface strength and degrades performance of mounted accessories. As shown at right in FIG. 10, however, the present mounting system 10 facilitates consistent and uniform clamping force throughout the entire inner surface of the handguard 8 without distorting the contour of the handguard 8. Accordingly, the mounting system 10 and handguard 8 facilitate improved interface strength as well as accurate and reliable performance of mounted accessories.

In some embodiments, the handguard 8 has a length of approximately 13 inches, a height of approximately 2 inches, an outer width of approximately 1.5 inches, and an inner width of approximately 1.3 inches. In some embodiments, the handguard 8 includes alloy steel with a nitride finish. In some embodiments, the handguard 8 includes composite materials. In some embodiments, the handguard 8 has a hard-coat anodized finish. In some embodiments, the handguard 8 has an approximately full-length or partial-length rail or rails, such as a 1913 picatinny rail one or more surfaces or sides. In some embodiments, the handguard 8 is compatible with accessories that mount using specifications identified by the mark M-LOK. In some embodiments, the handguard 8 has one or more sling sockets, such as the rotation-limited, quick-detach sling swivel sockets 44, 46, 48, 50 that are configured to receive a sling swivel, such as the push-button, quick-detach sling swivel 62 shown in FIG. 1. In some embodiments, the handguard 8 weighs approximately 14.5 ounces with the barrel nut 32.

In some embodiments, the mounting system 10 has only one fastener, such as only fastener 12 or only fastener 14. In some embodiments, more than two fasteners are included in the mounting system 10. In some embodiments, the nut plate 18 is omitted. In some embodiments, threads to receive the one or more fasteners of the mounting system 10 are defined in the handguard 8. In some embodiments, the threads in the handguard 8 are formed or cut into the handguard 8, such as in one or more of the braces 16 or 20. In some embodiments, the threads in the handguard 8 are defined by inserts disposed in the handguard 8, such as in one or more of the braces 16 or 20, such as threaded inserts available under the marks HELICOIL®, THREADSERT, or others.

As used herein, the following terms take the meanings explicitly associated herein, unless the context clearly dictates otherwise. The terms "front," "forward," "rear," and "rearward" are defined relative to shooting direction of the barrel. The terms "front" and "forward" indicate the end portion that is opposite of the upper receiver 4 when installed on the firearm. The terms "rear" and "rearward" indicate the end portion that is closer to the upper receiver 4 than the forward end portion when installed on the firearm. The terms "height," "vertical," "upper," "lower," "above," "below," "top," "bottom," "topmost," and "bottom-most" are defined relative to vertical axis of the firearm. The vertical axis is non-parallel to the longitudinal axis and is defined as parallel to the direction of the earth's gravity force on the firearm when the barrel is parallel to horizontal ground. The term "lateral" is defined relative to the lateral axis of the handguard 8. The lateral axis is non-parallel to the longitudinal and vertical axes. The longitudinal axis extends along the central axis of the barrel 6 when all components of the firearm are coupled to each other.

The term "configured" as used herein means an element being one or more of sized, dimensioned, positioned, or oriented to achieve or provide the recited function or result. The term "directly coupled" as used herein means that a component contacts (for example, when bolted) or is welded to another component. The term "indirectly coupled" as used herein means that a first component is coupled to a second component by way of one or more intervening components that are directly coupled to the first and second components. A first component that is indirectly coupled to a second component is directly coupled to a third component, which may be directly coupled to the second component or to a fourth component that is directly coupled to the second component. The term "coupled" should therefore be understood to disclose both direct and indirect coupling of components or elements that are described as being coupled to each other.

The term "substantially parallel" refers to parallel or within 5, 10, 15, 20, 25, 30, 35, 40, or 45 degrees of parallel. The term "substantially orthogonal" or "substantially perpendicular" refers to orthogonal or within 5, 10, 15, 20, 25, 30, 35, 40, or 45 degrees of orthogonal. The term "substantially horizontal" or "substantially horizontally" refers to horizontal or within 5, 10, 15, 20, 25, 30, 35, 40, or 45 degrees of horizontal. The term "substantially vertical" or "substantially vertically" refers to vertical or within 5, 10, 15, 20, 25, 30, 35, 40, or 45 degrees of vertical. The term "approximately" or "substantially" refers to within 1, 5, 10, 15, 20, 25, 30, 40, or 50 percent of the identified value or range.

The term "or" is an inclusive grammatical conjunction to indicate that one or more of the connected terms may be employed. For example, the phrase "one or more A, B, or C" or the phrase "one or more As, Bs, or Cs" is employed to discretely disclose each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" as used herein is not exclusive and allows for being based on additional factors not described. The articles "a," "an," and "the" include plural references. Plural references are intended to also disclose the singular.

While the preferred embodiment of the invention has been illustrated and described, as noted above, many changes can be made without departing from the spirit and scope of the invention. Each disclosure of a component preferably having a feature or characteristic is intended to also disclose the component as being devoid of that feature or characteristic, unless the principles of the invention clearly dictate otherwise. Accordingly, the scope of the invention is not limited by the disclosure of the preferred embodiment. Instead, the invention should be determined entirely by reference to the claims that follow. It should also be noted that the claim dependencies or combinations of elements recited in the claims does not reflect an intention to forgo claiming other subject matter disclosed herein. Instead, this disclosure is intended to also disclose the subject matter of any combination of any two or more of the claims, such that subsequent claim sets may recite that any one of the dependent claims depends from any other one or more claims, up to and including all other claims in the alternative (such as "The apparatus or method of any one of the preceding or subsequent claims . . . ."). This disclosure is also intended to disclose the subject matter of any one of the dependent claims, as if it was an independent claim, with or without all or a portion of the subject matter of the original independent claim(s) or any other subject matter disclosed herein.

The invention claimed is:

1. A handguard system for an AR pattern rifle, the system comprising:

a handguard defining a first fastener aperture in a first side of an upper portion of the handguard and a second fastener aperture in a second side of the upper portion of the handguard; and a first fastener configured to extend through the first and second fastener apertures, the first fastener being configured to clamp the handguard to a barrel nut of the rifle, wherein the system is devoid of separable components disposed between at least one end portion of the first fastener and an exterior surface of the handguard when the handguard is installed on the rifle, whereby the system increases the ease of installing and servicing the handguard on the rifle.

2. The system of claim 1, wherein the handguard defines at least one recess in a rear end portion of the handguard, the at least one recess being configured to receive at least a portion of an upper receiver of the rifle, whereby the at least one recess prevents the handguard from rotating relative to the upper receiver when fully installed on the rifle.

3. The system of claim 2, wherein the at least one recess comprises an upper recess and a lower recess disposed on opposing sides of a receiving opening defined by the handguard, the receiving opening being configured to receive the upper receiver, the handguard defining a threaded aperture sized and dimensioned to receive a set screw that protrudes into the upper recess and presses the upper receiver.

4. The system of claim 1, wherein the handguard defines a third fastener aperture in the first side of the upper portion of the handguard and a fourth fastener aperture in the second side of the upper portion of the handguard, wherein a second fastener is configured to extend through the third and fourth fastener apertures and to clamp the handguard to the barrel nut, the third and fourth apertures being configured to prevent the first and second fasteners from contacting each other when the handguard is fully installed on the rifle.

5. The system of claim 1, wherein the handguard defines a first brace on one of the first side or the second side of the upper portion of the handguard, the first brace defining the first aperture and providing an exterior surface that is substantially perpendicular to a longitudinal axis of the first fastener, whereby the first brace facilitates increasing the clamping force applied to the handguard without additional components being handled during installation of the handguard on the rifle.

6. The system of claim 5, wherein the handguard defines a second brace on one of the first side or the second side of the upper portion of the handguard that is opposite to the first brace, the second brace defining the second aperture and providing another exterior surface that is substantially perpendicular to the longitudinal axis of the first fastener, whereby the second brace facilitates increasing the clamping force applied to the handguard without additional components being handled during installation of the handguard on the rifle.

7. The system of claim 5, further comprising a threaded plate that is configured to threadably receive the first fastener while the plate is disposed on the exterior surface of the first brace.

8. A handguard system for an AR pattern rifle, the handguard system comprising:

a handguard defining a first fastener aperture in a first side of an upper portion of the handguard, a second fastener aperture in a second side of the upper portion of the handguard, a third fastener aperture in the first side of the upper portion, and a fourth fastener aperture in the second side of the upper portion, the first fastener aperture and the second fastener aperture each being positioned along a first fastener axis, and the third fastener aperture and the fourth fastener aperture each being positioned along a second fastener axis;

a first fastener configured to extend along the first fastener axis and into the first and second fastener apertures; and a second fastener configured to extend along the second fastener axis and into the third and fourth fastener apertures, wherein the first fastener and second fastener are configured to extend into the handguard to be positioned within recessed space defined by a notched surface of a barrel nut, wherein the first and second fasteners do not contact each other, whereby the first fastener and the second fastener extending into the fastener apertures of the upper portion of the handguard facilitate improved interface strength as well as ease of installing the handguard.

9. The handguard system of claim 8, further comprising the barrel nut defining the notched surface, the notched surface extending partially along a length of the barrel nut, wherein the first fastener and the second fastener contact a profile of the notched surface to prevent longitudinal movement of the handguard relative to the barrel nut.

10. The handguard system of claim 8, wherein the handguard defines a first brace on the first side of the upper portion of the handguard, the first brace defining the first fastener aperture and the third fastener aperture, the first brace providing an exterior surface that is substantially perpendicular to a longitudinal axis of the first fastener.

11. The system of claim 10, wherein the handguard defines a second brace on the second side of the upper portion of the handguard opposite to the first brace, the second brace defining the second fastener aperture and the fourth fastener aperture, the second brace providing another exterior surface that is substantially perpendicular to the longitudinal axis of the first fastener.

12. The system of claim 11, wherein one of the first brace and the second brace define threads for receiving at least one of the first fastener and the second fastener.

13. The system of claim 12, wherein one of the first brace or the second brace includes a nut plate that defines the threads.

14. A handguard system for an AR pattern rifle, the handguard system comprising:

a handguard defining a first fastener aperture in a first side of an upper portion of the handguard and a second fastener aperture in a second side of the upper portion of the handguard, the first fastener aperture and the second fastener aperture each being positioned along a first fastener axis; and a first fastener configured to extend along the first fastener axis and into the first and second fastener apertures, wherein the first fastener is configured to extend into the handguard to be positioned within a notched surface defined by a barrel nut such that the first fastener is disposed between the barrel nut and a gas tube, wherein the first fastener has at least one cross section with multiple diameters that include a first diameter and a second diameter, the first diameter being larger than a distance between the notched surface of the barrel nut and the gas tube, the second diameter being at least as small as the distance between the notched surface of the barrel nut and the gas tube, whereby the first fastener extending into the fastener apertures of the upper portion of the handguard facilitates improved interface strength while the multiple diameters of the first fastener permit installing the handguard after installation of the gas tube in a manner that permits the first fastener to withstand larger torsional forces than if the first fastener had only the second diameter.

15. The handguard system of claim 14, wherein the the notched surface extends partially along a length of the barrel nut such that, when the barrel nut and the first fastener are positioned within the handguard, the first fastener extends into a notch defined by the notched surface to prevent longitudinal movement of the handguard relative to the barrel nut.

16. The handguard system of claim 15, wherein the barrel nut has a generally cylindrical shape and the notch is a reduced-radial section along a length of the barrel nut.

17. The handguard system of claim 16, wherein the first fastener is configured to contact at least one end of the notch in the barrel nut when the barrel nut and the first fastener are positioned within the handguard.

18. The handguard system of claim 14, wherein the handguard further includes an accessory rail, and the first fastener is positioned between barrel nut and the accessory rail.

19. The handguard system of claim 18, further comprising a second fastener, wherein the handguard further defines a third fastener aperture in the first side of the upper portion, and a fourth fastener aperture in the second side of the upper portion, and the third fastener aperture and the fourth fastener aperture are each positioned along a second fastener axis, the second fastener is configured to extend along the second fastener axis and through the third and fourth fastener apertures.

20. The handguard system of claim 14, wherein the handguard further includes a first brace on the first side of the upper portion of the handguard and a second brace on the second side of the upper portion of the handguard opposite to the first brace, the first brace defining the first fastener aperture, the second brace defining the second fastener aperture, the first brace and the second brace extending substantially in parallel in the vertical dimension.

* * * * *